US008951364B2

(12) United States Patent
Waeckerle et al.

(10) Patent No.: US 8,951,364 B2
(45) Date of Patent: Feb. 10, 2015

(54) HIGHLY DYNAMIC ELECTROMAGNETIC ACTUATOR COMPRISING A MOVABLE CORE MADE FROM AN FE-CO ALLOY

(75) Inventors: Thierry Waeckerle, Nevers (FR); Herve Fraisse, Saint-Eloi (FR)

(73) Assignee: Aperam Alloys Imphy (FR)

( * ) Notice: Subject to any disclaimer, the term of this patent is extended or adjusted under 35 U.S.C. 154(b) by 515 days.

(21) Appl. No.: 12/863,696

(22) PCT Filed: Jan. 14, 2009

(86) PCT No.: PCT/FR2009/000039

§ 371 (c)(1),
(2), (4) Date: Oct. 11, 2010

(87) PCT Pub. No.: WO2009/112672

PCT Pub. Date: Sep. 17, 2009

(65) Prior Publication Data

US 2011/0018658 A1 Jan. 27, 2011

(30) Foreign Application Priority Data

Jan. 22, 2008 (EP) ..... 08290057

(51) Int. Cl.

| | |
|---|---|
| ***C22C 38/30*** | (2006.01) |
| ***C22C 38/52*** | (2006.01) |
| ***H01F 7/06*** | (2006.01) |
| ***H01F 1/147*** | (2006.01) |
| ***C22C 38/02*** | (2006.01) |

(52) U.S. Cl.

CPC ..... *H01F 1/14775* (2013.01); *C22C 38/02* (2013.01); *C22C 38/30* (2013.01); *H01F 1/14716* (2013.01); *H01F 1/14791* (2013.01)

USPC ..... 148/311; 148/307; 148/310; 148/309; 420/104; 420/107; 420/117; 335/219; 335/299

(58) Field of Classification Search

USPC ..... 148/120, 121, 311, 307, 310; 420/104, 420/107, 117

See application file for complete search history.

(56) References Cited

U.S. PATENT DOCUMENTS

| | | | | |
|---|---|---|---|---|
| 2004/0099347 | A1 * | 5/2004 | Waeckerle et al. | ..... 148/311 |
| 2007/0029013 | A1 | 2/2007 | Waeckerle et al. | |

FOREIGN PATENT DOCUMENTS

| | | | |
|---|---|---|---|
| EP | 0715320 | A1 * | 6/1996 |
| JP | S43001259 | B | 1/1943 |
| JP | 51 92097 | | 8/1976 |
| JP | 06-033199 | * | 2/1994 |
| JP | H0841604 | A | 2/1996 |
| JP | 2004515644 | A | 5/2004 |
| WO | 01 86665 | | 11/2001 |
| WO | WO0186665 | | 11/2001 |

OTHER PUBLICATIONS

Machine-English translation of EP 0715320-A1, Kurt Emmerich et al., Jun. 5, 1996.*

Machine-English translation of Japanese patent 06-033199, Nagatsuka Hironobu et al., Feb. 8, 1994.*

Machine-English translation of Japanese patent No. 08-041604, Feb. 13, 1996, Uchibori Katsuyuki et al.*

English Translation of the Office Action issued in connection with Japanese Patent Application No. 2010-543537 on Apr. 23, 2013, along with the Office Action in Japanese.

* cited by examiner

*Primary Examiner* — Deborah Yee

(74) *Attorney, Agent, or Firm* — Davidson, Davidson & Kappel, LLC

(57) ABSTRACT

The invention relates to an Fe—Co alloy, the composition of which comprises in % by weight:

$6 \leq Co+Ni \leq 22$ $Si \geq 0.2$ $0.5 \leq Cr \leq 8$ $Ni \leq 4$ $0.10 \leq Mn \leq 0.90$ $Al \leq 4$ $Ti \leq 1$ $C \leq 1$ $Mo \leq 3$ $V+W \leq 3$ $Nb+Ta \leq 1$ $Si+Al \leq 6$ $O+N+S+P+B \leq 0.1$ the balance of the composition consisting of iron and inevitable impurities due to the smelting, it being furthermore understood that the contents thereof satisfy the following relationships:

$Co+Si-Cr \leq 27$ $Si+Al+Cr+V+Mo+Ti \geq 3.5$ $1.23(Al+Mo)+0.84(Si+Cr+V) \geq 1.3$ $14.5(Al+Cr)+12(V+Mo)+25\ Si \geq 50.$

18 Claims, No Drawings

HIGHLY DYNAMIC ELECTROMAGNETIC ACTUATOR COMPRISING A MOVABLE CORE MADE FROM AN FE-CO ALLOY

The present invention relates to an Fe-Co alloy more particularly intended for the manufacture of an electromagnetic actuator having a large dynamic range, without in any way being limited thereto.

An electromagnetic actuator is an electromagnetic device that converts electrical energy into mechanical energy with an electromagnetic conversion mode. Some of these actuators are called "linear" actuators since they convert the received electrical energy into a linear displacement of a movable part. Such actuators are encountered in solenoid valves and in electronic injectors.

A preferred application of such electronic injectors is the direct injection of fuel in internal combustion engines, especially diesel engines. Another preferred application relates to a particular type of solenoid valve used for electromagnetically controlling the valves of internal combustion engines (whether petrol or diesel engines).

In these actuators, the electrical energy is delivered into a coil by a series of current pulses, creating a magnetic field that magnetizes an open magnetic yoke, therefore one having a gap. The geometric characteristics of the yoke enable most of the magnetic field lines to be directed axially with respect to the gap region. Under the effect of the electrical pulse, the gap is subjected to a magnetic potential difference.

The actuator also includes a core that can move under the action of the electric current in the coil. Specifically, the magnetic potential difference introduced into the coil between the movable core at rest on one of the poles of the yoke and the opposed pole of the yoke creates an electromagnetic force on the magnetized core via a magnetic field gradient. The magnetized core is thus moved. The rest position may also be located in the middle of the gap thanks to two symmetrical springs, thereby enhancing, through their stiffness, the dynamic range of the movable part, in particular for electromagnetically controlled valves.

The movement of the movable core takes place with a phase shift with respect to the instant of generation of the electrical pulses. For optimum operation of the actuator, it may be shown that it is necessary for the metal to have a high electrical resistivity $\rho_{el}$ at 20° C., particularly above 50 μΩ.cm, and a low coercive field $H_c$, i.e. less than 32 Oe and preferably less than 8 Oe. These conditions provide an excellent dynamic magnetization range by the generation of small currents induced in the yoke and the magnetic core, making it possible for the minimum magnetization of the core causing it to move to be rapidly achieved. This excellent dynamic range thus makes it possible to reduce the actuation times and the power consumption of the actuator.

It is also necessary for the core to possess a high saturation magnetization $J_s$, i.e. greater than 1.75 T and preferably greater than 1.9 T so as to permit the highest possible maximum force at the end of the pulse. It is specifically this force that guarantees that the actuator is held in open or closed position, this being particularly important when the flow of a high-pressure fluid is to be completely stopped or when the restoring force of one or more springs is to be compensated for. Such a level of saturation magnetization thus results in a compact actuator of high volume power and force.

These magnetic cores have various shapes that can be manufactured from rolled wire, bar, plate or sheet. They must therefore have good hot transformability and preferably, when necessary, good cold formability.

Once manufactured and in service, these cores may be subjected to a slightly oxidizing working environment and must therefore have good corrosion resistance in order to withstand this type of premature wear.

They are also subjected to multiple shocks when they complete their travel by suddenly butting against a stop, and must therefore have good mechanical properties, i.e., in practice, a tensile strength $R_m$ of greater than 500 MPa and preferably a yield strength $R_{0.2}$ greater than 250 MPa in the hot-rolled state for a thickness of at least 2 mm.

In general, iron-cobalt (Fe-Co) alloys such as those described in EP 715 320 are used for the manufacture of electromagnetic actuators. The materials described contain 6 to 30% cobalt and 3 to 8% of one or more elements chosen from chromium, molybdenum, vanadium and/or tungsten, the balance being iron. However, these alloys have an insufficient dynamic range.

The object of the present invention is to provide a material suitable for the inexpensive manufacture of cores for compact electromagnetic actuators having a high dynamic range and a high saturation. This material must furthermore allow improved hot processing, and preferably cold processing.

A first subject of the invention thus consists of an Fe-Co alloy, the composition of which comprises in % by weight:

$$6 \le Co+Ni \le 22$$

$$Si \ge 0.2$$

$$0.5 \le Cr \le 8$$

$$Ni \le 4$$

$$0.10 \le Mn \le 0.90$$

$$Al \le 4$$

$$Ti \le 1$$

$$C \le 1$$

$$Mo \le 3$$

$$V+W \le 3$$

$$Nb+Ta \le 1$$

$$Si+Al \le 6$$

$$O+N+S+P+Bs \le 0.1$$

the balance of the composition consisting of iron and inevitable impurities due to the smelting, it being furthermore understood that the contents thereof satisfy the following relationships:

$$Co+Si-Cr \le 27$$

$$Si+Al+Cr+V+Mo+Ti \ge 3.5$$

$$1.23(Al+Mo)+0.84(Si+Cr+V) \ge 1.3$$

$$14.5(Al+Cr)+12(V+Mo)+25\ Si \ge 50.$$

In particular embodiments, considered individually or in combination, the alloy may furthermore have the following additional features:

the Fe-Co alloy is such that: 10 ≤% Co+% Ni≤22;

the Fe-Co alloy is such that: 1≤Cr≤5.5;

the Fe-Co alloy is such that: Ni≤1;

the Fe-Co alloy is such that: Al≤2.

In one more particularly preferred embodiment, the alloy according to the invention has a composition, in % by weight, which comprises:

$6 \leq Co+Ni \leq 22$ $Si \geq 0.2$ $0.5 \leq Cr \leq 6$ $Ni \leq 1$ $0.10 \leq Mn \leq 0.90$ $Al \leq 4$ $Ti \leq 0.1$ $Cs \leq 0.1$ $Mo \leq 3$ $V+W \leq 3$ $Nb+Ta \leq 1$ $S+Al \leq 6$ $O+N+S+P+B \leq 0.1$ the balance of the composition consisting of iron and impurities due to the smelting, it being furthermore understood that the silicon, aluminum, cobalt, chromium, vanadium, molybdenum, titanium and nickel contents thereof satisfy the following relationships:

$Co+Si-Cr \leq 27$ $Si+Al+Cr+V+Mo+Ti > 3.5$ $1.23(Al+Mo)+0.84(Si+Cr+V) \geq 1.3$ $14.5(Al+Cr)+12(V+Mo)+25\ Si \geq 50.$ The alloy according to the invention may be formed into bar, wire or plate or rolled sheet.

The alloy may in particular serve for the manufacture of a movable core of an electromagnetic actuator manufactured from a bar or from a wire or from a rolled plate or sheet.

Such an electromagnetic actuator having a movable core made of an Fe-Co alloy according to the invention may in particular be used within an injector for an electronically controlled internal combustion engine or else as a valve actuator for an electronically controlled internal combustion engine.

As may be seen above, the alloy according to the invention is an iron-cobalt alloy having a low cobalt content and having moderate contents of addition elements.

The cobalt content, in which the cobalt may be partially substituted with nickel, is between 6 and 22% by weight so as to obtain good saturation magnetization while still maintaining a high resistivity. It is less than 22% by weight in order to reduce the amount of costly addition elements, while still maintaining good saturation.

The nickel content, which may be partially substituted for cobalt, is however maintained at less than 4% as its presence considerably increases the coercive field of the alloy.

The silicon content of the alloy according to the invention is equal to or greater than 0.2% by weight. Such a minimum content enables a good mechanical strength $R_m$ to be obtained. Furthermore, this element enables the coercive field of the alloy to be very effectively increased by significantly lowering it. However, the combined addition of aluminum and silicon is limited to 6% in order for the alloy to maintain good hot transformability. It is furthermore preferred to limit this combined content to less than 4% by weight in order for the alloy to maintain good cold transformability.

The aluminum content of the alloy according to the invention is equal to or less than 4% by weight. This element plays a similar role to that of silicon by promoting a low coercive field. Its addition is limited to 4% as otherwise $J_s$ would become too low. However, it does not improve the mechanical properties of the alloy.

The chromium content of the alloy according to the invention is between 0.5 and 8% by weight. This essential element of the alloy enables the silicon addition range to be extended, in respect to cold and hot transformation, while still maintaining good resistivity and saturation properties. However, its addition is limited, as it increases the coercive field of the alloy.

The manganese content of the alloy according to the invention is equal to or less than 0.90% by weight. This element is added in an amount of at least 0.10% by weight in order to improve the hot transformability of the alloy. its content is limited since it is an element promoting the gamma-phase and the appearance of the γ-phase greatly degrades the magnetic performance.

The titanium content of the alloy according to the invention is equal to or less than 1%, preferably less than 0.1% by weight, as this element easily forms nitrides, either during smelting or when being annealed in air or in ammonia, which nitrides greatly degrade the magnetic properties and are therefore deleterious.

The molybdenum content of the alloy according to the invention is equal to or less than 3% by weight. This element may be added to improve the electrical resistivity of the alloy, as a complement to or as a partial substitution for chromium.

The carbon content of the alloy according to the invention is equal to or less than 1% by weight and preferably equal to or less than 0.1% by weight. The presence of carbon degrades the magnetic properties of the alloy and therefore the carbon content is reduced in order to prevent such degradation.

The combined content of vanadium and tungsten of the alloy according to the invention is equal to or less than 3% by weight. These elements may be added to improve the electrical resistivity of the alloy, as a complement to or as a partial substitution for chromium.

The combined content of niobium and tantalum of the alloy according to the invention is equal to or less than 1% by weight. These elements may be added to improve the ductility of the alloy and thus limit its brittleness.

Finally, the combined content of oxygen, nitrogen, sulphur, phosphorous and boron is limited to 0.1% by weight, since these elements are oxidizing and tend to form precipitates that are highly unfavourable to the magnetic properties and to the mechanical ductility of the material. Such a limit assumes in particular that the alloy according to the invention is manufactured from raw materials of high purity.

Moreover, the alloy according to the invention must also satisfy a number of relationships among some of these elements. Thus, the following four relationships must be satisfied:

$$Co+Si-Cr \leq 27 \quad (1)$$

$$Si+Al+Cr+V+Mo+Ti > 3.5 \quad (2)$$

$$1.23(Al+Mo)+0.84(Si+Cr+V) \geq 1.3 \quad (3)$$

$$14.5(Al+Cr)+12(V+Mo)+25\ Si \geq 50 \quad (4)$$

Relationship (1) makes it possible, by balancing the silicon and chromium, to guarantee good hot transformability and therefore absence of crazes or cracks when forging and rolling.

Relationship (2), in combination with relationship (4), makes it possible to guarantee a high electrical resistivity $\rho_{el}$, in particular one greater than 50 μΩ.cm.

Relationship (3) represents a saturation criterion that enables the alloy according to the invention to have a saturation magnetization $J_s$ of less than 2.2 T in a manner consistent with the addition of non-magnetic elements necessary for the high dynamic magnetization range requirement.

Relationship (4), in combination with relationship (2), makes it possible to ensure a high electrical resistivity $\rho_{el}$ and in particular one greater than 50 μΩ.cm.

The manufacture of the alloy according to the invention may be carried out conventionally for this type of alloy. Thus, the various elements making up the composition of the alloy may be vacuum induction melted and then cast into ingots, billets or slabs. These are then hot forged at temperatures ranging from 1000 to 1200° C., and then hot-rolled after being reheated to a temperature of 1150° C. or higher, the end-of-rolling temperature being between 800 and 1050° C.

The hot-rolled plate, bar or strip thus produced may be used in this state or else cold-rolled after pickling by being dipped into one or more acid tanks, and annealed.

It is also possible, to further improve the dynamic magnetization range of the alloy according to the invention, using any process adapted to the surface of the part manufactured, to make deposited elements diffuse beneath the surface. Such elements may for example be aluminum, silicon or chromium.

Trials

The raw materials needed to produce the alloy were vacuum induction melted and cast in a vacuum into 50 kg ingots. The ingots were then hot-forged between 1000 and 1200° C. and then, after being reheated to 1150° C., hot-rolled down to a thickness of 4 to 5 mm for an end-of-hot-rolling temperature of at least 800° C. After being chemically pickled in acid, the strips are either characterized in the hot-rolled state by the machining of tensile test specimens, round specimens for magnetic characterization or elongate specimens for electrical resistivity measurement, or else characterized after cold-rolling down to a thickness of 0.6 mm for the same type of sampling and characterization.

Depending on the case, these two types of metallurgical state (HR: hot-rolled state CR: cold-rolled state) may be characterized as such or after being annealed at 900° C. for 4 hours in $H_2$ and rapid cooling. Unless otherwise indicated, all the following data were obtained after cold-rolling and annealing.

The tensile strength $R_m$ was measured on a tensile test specimen after a hot-rolled strip had been annealed at 900° C. for 4 hours in $H_2$.

The corrosion resistance $T_{cor}$ was evaluated on the as-hot-rolled surface, which was ground so as to have a clean surface and a very low roughness, and then left at 20° C. in a salt-spray atmosphere.

The hot or cold transformability test was carried out by simple observation of non-brittle edges during the (hot and cold) rolling operations on the trial ingots.

The compositions of the trial heats are given in Table 1 below, it being understood that the combined contents in all the trials of oxygen, nitrogen, sulphur, phosphorous and boron are less than 0.1% by weight and that the balance of the compositions consists of iron.

TABLE 1

| Trial | % Co | % Ni | % Si | % Cr | % Mn | % Al | % Ti | % Mo | % V | % W | % Nb | % Ta |
|---|---|---|---|---|---|---|---|---|---|---|---|---|
| 1 | 18 | — | — | 5 | 0.2 | 1 | — | — | — | — | — | — |
| 2* | 18 | — | 0.5 | 5 | 0.2 | 0.5 | 0.02 | — | — | — | — | — |
| 3* | 18 | 1 | 0.3 | 4.7 | 0.2 | — | — | 0.1 | — | — | — | — |
| 4* | 18 | 2 | 0.3 | 4.7 | 0.2 | — | — | — | 0.15 | — | — | — |
| 5* | 18 | 3 | 0.3 | 4.7 | 0.2 | — | — | — | — | 0.2 | — | — |
| 6 | 18 | — | 0.5 | 2.7 | 0.2 | — | — | — | — | — | — | — |
| 7* | 18 | — | 1 | 3 | 0.2 | — | — | — | — | — | 0.03 | — |
| 8* | 18 | — | 2 | 3 | 0.2 | — | — | — | — | — | — | — |
| 9* | 18 | — | 3 | 3 | 0.2 | — | — | — | — | — | — | — |
| 10* | 18 | — | 1 | 7 | 0.2 | — | — | — | — | — | — | — |
| 11* | 18 | — | 2 | 7 | 0.2 | — | — | — | — | — | — | — |
| 12* | 18 | — | 3 | 7 | 0.2 | — | — | — | — | — | — | — |
| 13* | 18 | — | 4 | 7 | 0.2 | — | — | — | — | — | — | — |
| 14 | 18 | — | 3.46 | — | 0.2 | — | — | — | — | — | — | — |
| 15 | 18 | — | 3.5 | 0.2 | 0.2 | — | — | — | — | — | — | — |
| 16 | 18 | — | 0.55 | 2.87 | 0.2 | — | — | — | — | — | — | — |
| 17 | 18 | — | 1.04 | 2.11 | 0.2 | — | — | — | — | — | — | — |
| 18* | 18 | — | 0.99 | 4.98 | 0.2 | — | — | — | — | — | — | — |
| 19* | 18 | — | 2.05 | 5.18 | 0.2 | — | — | — | — | — | — | — |
| 20* | 18 | — | 2.99 | 4.97 | 0.2 | — | — | — | — | — | — | — |
| 21* | 18 | — | 3.96 | 4.9 | 0.2 | — | — | — | — | — | — | — |
| 22* | 18 | — | 1 | 4 | 0.2 | — | — | — | 1 | — | — | — |
| 23* | 18 | — | 3 | 4 | 0.2 | — | — | — | 1 | — | — | — |
| 24* | 18 | — | 5 | 4 | 0.2 | — | — | — | 1 | — | — | — |
| 25 | 18 | — | 7 | 4 | 0.2 | — | — | — | 1 | — | — | — |
| 26* | 18 | — | 4 | 5 | 0.2 | — | — | — | — | — | — | 0.2 |

*trial according to the invention.

The results of the trials are given in Table 2 below.

TABLE 2

| Trial | $J_s$ (T) | $\rho_{el}$ (μΩ. cm) | $H_c$ (Oe) | HR | CR | $R_m$ (MPa) | $T_{cor}$ |
|---|---|---|---|---|---|---|---|
| 1 | 2.06 | 63.5 | 3.79 | Yes | Yes | 480 | ++ |
| 2* | 2.07 | 65 | 3.6 | Yes | Yes | 522 | ++ |
| 3* | 2.11 | 56.4 | 16.6 | Yes | Yes | 505 | ++ |
| 4* | 2.09 | 61.1 | 17.3 | Yes | Yes | 505 | ++ |

TABLE 2-continued

| Trial | $J_s$ (T) | $\rho_{el}$ (μΩ. cm) | $H_c$ (Oe) | HR | CR | $R_m$ (MPa) | $T_{cor}$ |
|---|---|---|---|---|---|---|---|
| 5* | 2.07 | 61.7 | 22.2 | Yes | Yes | 506 | ++ |
| 6 | 2.17 | 46.8 | 0.91 | Yes | Yes | 520 | ++ |
| 7* | 2.13 | 53.7 | 1.22 | Yes | Yes | 564 | ++ |
| 8* | 2.08 | 63.4 | 0.8 | Yes | Yes | 648 | ++ |
| 9* | 2.01 | 68.9 | 0.6 | Yes | No | 732 | ++ |
| 10* | 2 | 71 | 18.7 | Yes | Yes | 563 | ++ |
| 11* | 1.94 | 80.5 | 20.5 | Yes | Yes | 642 | ++ |
| 12* | 1.88 | 90.4 | 15.7 | Yes | No | 730 | ++ |
| 13* | 1.82 | 96.6 | 12.3 | Yes | No | 798 | ++ |
| 14 | 2.04 | 48.4 | 0.5 | Yes | No | 760 | 0 |
| 15 | 2.02 | 51 | 0.4 | Yes | No | 752 | 0 |
| 16 | 2.14 | 48 | 2.6 | Yes | Yes | 522 | ++ |
| 17 | 2.13 | 47 | 2.2 | Yes | Yes | 565 | + |
| 18* | 2.01 | 68 | 5.15 | Yes | Yes | 567 | ++ |
| 19* | 1.92 | 80.5 | 4.95 | Yes | Yes | 644 | ++ |
| 20* | 1.88 | 86 | 3.15 | Yes | Yes | 730 | ++ |
| 21* | 1.80 | 96.5 | 2.13 | Yes | Yes | 792 | ++ |
| 22* | 2.11 | 52 | 3.51 | Yes | Yes | 566 | ++ |
| 23* | 2.06 | 63.5 | 3.58 | Yes | Yes | 733 | ++ |
| 24* | 2 | 75.7 | 2.59 | Yes | Yes | 850 | ++ |
| 25 | 1.85 | 98 | 1.7 | No | NE | NE | NE |
| 26* | 1.81 | 88.7 | 3 | Yes | No | 797 | ++ |

*trial according to the invention; NE: not evaluated.

As may be seen from these trials, the alloy according to the invention makes it possible to bring together a set of properties not accessible in the prior art, namely:

- a moderate-to-low coercive field $H_c$ at 20° C. on both very thick metallurgical states (HR plate a few mm in thickness) and on thin metallurgical states (cold-rolled down to 0.1 to 2 mm in thickness);
- excellent ductility in hot or cold transformation of the material;
- a high electrical resistivity at 20° C., typically >50 μΩ.cm, while still maintaining a high to very high saturation magnetization at 20° C., typically >1.75 T and preferably >1.9 T, though not being able to exceed 2.2 T owing to the additions needed for the large dynamic magnetization range of the alloy;
- a tensile strength of at least 500 MPa in the hot-rolled state for a thickness of at least 2 mm;
- a satisfactory corrosion resistance; and
- a limited cost of the material.

As seen above, a preferential application of the alloys according to the invention is the manufacture of cores for electromagnetic actuators, whether these be linear or rotary actuators. Such compact, dynamic and robust actuators may advantageously be used in injectors for direct-injection internal combustion engines, especially for diesel engines, and in movable parts of actuators controlling the movement of valves for internal combustion engines.

The invention claimed is:

1. An electromagnetic actuator comprising a movable core manufactured from a bar, a wire or a rolled plate or sheet made of an Fe—Co alloy, the composition of which comprises in % by weight:

$6 \leq Co+Ni \leq 22$ $Si \geq 0.2$ $0.5 \leq Cr \leq \leq 8$ $Ni \leq 4$ $0.10 \leq Mn \leq 0.90$ $Al \leq 4$ $Ti \leq 1$ $C \leq 1$ $Mo \leq 3$ $V+W \leq 3$ $Nb+Ta \leq 1$ $Si+Al \leq 6$ $O+N+S+P+B \leq 0.1$ the balance of the composition consisting of iron and inevitable impurities due to the smelting, it being furthermore understood that the contents thereof satisfy the following relationships:

$Co+Si-Cr \leq 27$ $Si+Al+Cr+V+Mo+Ti \geq 3.5$ $1.23(Al+Mo)+0.84(Si+Cr+V) \geq 1.3$ $14.5(Al+Cr)+12(V+Mo)+25Si \geq 50.$

2. The electromagnetic actuator of claim 1, in which:

$10 \leq \%\ Co+\%\ Ni \leq 22.$

3. The electromagnetic actuator of claim 1, in which:

$1 \leq Cr \leq 5.5.$

4. The electromagnetic actuator of claim 1, in which:

$Ni \leq 1.$

5. The electromagnetic actuator of claim 1, in which:

$Al \leq 2.$

6. The electromagnetic actuator of claim 1, the composition in % by weight of which comprises:

$6 \leq Co+Ni \leq 22$ $Si \geq 0.2$ $0.5 \leq Cr \leq 6$ $Ni \leq 1$ $0.10 \leq Mn \leq 0.90$ $Al \leq 4$ $Ti \leq 0.1$ $C \leq 0.1$ $Mo \leq 3$ $V+W \leq 3$ $Nb+Ta \leq 1$ $Si+Al \leq 6$ $O+N+S+P+B \leq 0.1$ the balance of the composition consisting of iron and impurities due to the smelting, it being furthermore understood that the silicon, aluminium, cobalt, chromium, vanadium, molybdenum, titanium and nickel contents thereof satisfy the following relationships:

$Co+Si—Cr \leq 27$ $$Si+Al+Cr+V+Mo+Ti \geq 3.5$$

$$1.23(Al+Mo)+0.84(Si+Cr+V) \geq 1.3$$

$$14.5(Al+Cr)+12(V+Mo)+25Si \geq 50.$$

7. An injector for an electronically controlled internal combustion engine comprising the electromagnetic actuator according to claim 1.

8. An electronically controlled internal combustion engine comprising the electromagnetic actuator according to claim 1.

9. The electromagnetic actuator of claim 1, wherein the Fe—Co alloy has an electrical resistivity $P_{el}$ of above 50 μΩcm at 20° C. and a coercive field $H_c$ of less than 32 $O_e$.

10. The electromagnetic actuator of claim 9, wherein the coercive field $H_c$ is less than 8 $O_e$.

11. The electromagnetic actuator of claim 1, wherein the Fe—Co alloy has a tensile strength $R_m$ of greater than 500 MPa for a thickness of 2 mm.

12. The electromagnetic actuator of claim 11, wherein the Fe—Co alloy has a yield strength $R_{0.2}$ of greater than 250 MPa in a hot-rolled state for a thickness of 2 mm.

13. The electromagnetic actuator of claim 1, wherein the Fe—Co alloy has a tensile strength of at least 500 MPa in the hot-rolled state for a thickness of at least 2 mm.

14. The electromagnetic actuator of claim 13, wherein the Fe—Co alloy has a saturation magnetization at 20° C. of greater than 1.75T.

15. The electromagnetic actuator of claim 14, wherein the saturation magnetization at 20° C. is greater than 1.9T.

16. The electromagnetic actuator of claim 14, wherein the saturation magnetization at 20° C. does not exceed 2.2 T.

17. The electromagnetic actuator of claim 6, wherein the Fe—Co alloy has an electrical resistivity $P_{el}$ of above 50 μΩcm at 20° C. and a coercive field $H_c$ of less than 32 $O_e$.

18. The electromagnetic actuator of claim 17, wherein the coercive field $H_c$ is less than 8 $O_e$ and the Fe—Co alloy has a tensile strength $R_m$ of greater than 500 MPa for a thickness of 2 mm.

* * * * *